US006117309A

United States Patent [19]

Daspit et al.

[11] Patent Number: 6,117,309

[45] Date of Patent: Sep. 12, 2000

[54] METHOD OF REREFINING WASTE OIL BY DISTILLATION AND EXTRACTION

[75] Inventors: Alexander D. B. Daspit, Dallas; Martin MacDonald, Plano; Thomas G. Murray, Aubrey, all of Tex.

[73] Assignee: Probex Corporation, Carrollton, Tex.

[21] Appl. No.: 08/925,279

[22] Filed: Sep. 8, 1997

[51] Int. Cl.[7] ..... C10G 27/00

[52] U.S. Cl. ..... 208/184; 208/189; 208/311; 208/179

[58] Field of Search ..... 208/189, 184, 208/179

[56] References Cited

U.S. PATENT DOCUMENTS

| | | | |
|---|---|---|---|
| 3,461,066 | 8/1969 | Morris | 208/321 |
| 4,021,333 | 5/1977 | Habiby | 208/179 |
| 4,057,491 | 11/1977 | Bushnell | 208/321 |
| 4,071,438 | 1/1978 | O'Blasny | 208/180 |
| 4,166,026 | 8/1979 | Fukui et al. | 208/210 |
| 4,247,389 | 1/1981 | Johnson | 208/181 |
| 4,294,689 | 10/1981 | Sequiera | 208/326 |
| 4,419,227 | 12/1983 | Sherman | 208/326 |
| 4,420,389 | 12/1983 | Beckworth | 208/151 |
| 4,941,967 | 7/1990 | Mannetje | 208/184 |
| 5,286,380 | 2/1994 | Mellen | 210/296 |

*Primary Examiner*—Helane E. Myers
*Attorney, Agent, or Firm*—Liniak, Berenato Longacre & White

[57] ABSTRACT

A process for recovering a base oil of lubricating viscosity from used oil in which, following optional pretreatment, used oil is re-refined by distilling it in distillation apparatus having multiple theoretical plates. Impurities are then extracted from the lube range distillate fraction or fractions with a liquid extractant such as N-Methyl-2-Pyrrolidone (NMP) at a temperature below the temperature, if any, of complete miscibility of the extractant and the oil. The oil and extractant are then separated whereupon the extractant is re-used in the process and the oil is subject to further treatment, as necessary, for targeted uses.

60 Claims, 1 Drawing Sheet

METHOD OF REREFINING WASTE OIL BY DISTILLATION AND EXTRACTION

FIELD OF THE INVENTION

This invention relates to the field of rerefining waste oils for use in lubricants and the like, and in particular to methods of rerefining waste oils to produce rerefined base oils which incorporate the steps of distillation followed by extraction of undesirable contaminants with a liquid extractant.

DESCRIPTION OF THE PRIOR ART

The prior art in this area is exemplified by U.S. Pat. Nos. 4,021,333, 4,071,438, and 4,302,325. Such liquid liquid extraction finishing rerefining processes have the inherent advantage relative to alternative base oil rerefining processes of not requiring the consumption of hydrogen or clay and of not generating any voluminous or hazardous waste byproduct streams. However, such processes have heretofore had significant economic shortcomings. Because of these shortcomings, all of the prior art patents in this area have expired or are nearing expiration without having been commercialized.

Relative to hydrofinishing, which is the predominant rerefined base oil finishing process employed in the United States, such liquid-liquid extraction processes eliminate the requirement for hydrogen, reduce the production of environmentally problematic byproducts, eliminate the need for high temperature, high pressure operations and thus are inherently safer (presuming a relatively non-toxic extractant is used), and eliminate the need for periodic catalyst replacement and handling.

However, unless practiced according to the methods of this invention, such processes either require a large and uneconomic volume of solvent, which contributes to a low yield of rerefined base oil, or produce a rerefined base oil of relatively low quality, which could be more simply produced via clay finishing. Where a high quality base oil is required, these shortcomings have heretofore caused these processes to be significantly less cost effective than hydrofinishing and accordingly have precluded their commercial implementation, notwithstanding their inherent advantages. Moreover, unless practiced according to the methods of this invention, such prior art processes may result in unacceptable fouling of process equipment.

OBJECTS OF THE INVENTION

Several objects and advantages of the invention are: 1) to achieve a relatively high yield of high quality rerefined base oil following distillation and extraction; 2) to reduce the volume of recirculating extractant required to produce a rerefined oil of a given quality; and 3) to reduce extractant loss at a given level of extractant recovery system complexity as a beneficial byproduct of reducing the volume of recirculating extractant required. A further object of the invention is to permit such efficient distillation and extraction without unacceptable fouling of process equipment.

Most broadly, the object of the invention is to provide an economically attractive alternative to hydrofinishing of rerefined oils which produces a base oil of comparable quality with few of hydrofinishing's operational and environmental liabilities.

SUMMARY OF THE INVENTION

The inventors have discovered that liquid liquid extraction finishing processes for used oil are surprisingly sensitive to the configuration of the distillation apparatus used to fractionate the distillate prior to finishing. Use of a distillation column with effective packing and multiple theoretical plates to separate distillate from used oil prior to finishing permits a high quality rerefined oil to be finished through liquid liquid extraction on a more cost effective basis than is possible through hydrotreating or any other known finishing process. However, if in accordance with typical rerefining practice, loose grid packing or a wiped film evaporator is employed for distillation prior to finishing, liquid liquid extraction finishing is less economically attractive than hydrofinishing. The failure to recognize the importance of this issue has precluded successful commercialization of the prior art processes in this area notwithstanding the well developed body of knowledge on the design and construction of liquid liquid extraction units themselves, which has been perfected in the course of their application to virgin lubricant processing in solvent refining units.

To summarize a preferred embodiment of the process, the oil is first pretreated, employing means well known to those schooled in the art, to remove entrained water and a portion of the volatile low boiling components unsuitable for incorporation in lubricants. Preferably, this pretreatment process also incorporates thermal treatment or additive separation steps known in the art which expressly or incidentally reduce used oil's propensity to foul, such as are set forth in U.S. Pat. Nos. 4,247,389, 4,420,389, 5,286,380, 5,306,419, or 5,556,548, the disclosures of which are incorporated herein by reference thereto.

The oil is then vacuum distilled in a packed column having multiple theoretical plates, equilibrium stages, or steps. The distillation apparatus employed must have more than one theoretical plate, and will preferably have more than 1½ or more than 2 theoretical plates. It is noted that the term "packed column" as used herein is intended to encompass a vacuum column operating under reduced pressure and comprising either random packing or structured packing, or a combination thereof.

Vacuum distillation in the aforesaid packed column separates the base oil boiling range material with an atmospheric equivalent boiling range of approximately 650° F. to 1000° F. from any remaining low boiling components not removed during the pretreatment process and from the heavy asphaltic components and metals which are unsuitable for incorporation in lubricants and which also tend to frustrate solvent extraction finishing. Optionally, the vacuum distillation step may concurrently segregate the lube distillate into various viscosity cuts which are separately solvent finished; however it is desirable that effective fractionation with multiple theoretical plates separate even the heaviest distillate fraction from the asphaltic residue.

Following distillation, the lube fraction or fractions are routed to a countercurrent liquid liquid extractor such as a rotating disk contactor where they are contacted with an extractant such as N-Methyl-2-Pyrrolidone (NMP) at a temperature below the temperature of complete miscibility of the solvent and the oil. The extractant will ordinarily be a polar organic solvent or a mixture thereof. It should be preferentially miscible with and thereby preferentially extract undesirable impurities, such as aromatics and unsaturated hydrocarbons, and sulfur, nitrogen, and oxygen containing compounds, from the oil over some range of temperatures and pressures. It should be, at the operating temperatures and pressures, relatively immiscible with the primary product material base oil which is being purified.

Raffinate and extract phases are formed in the liquid liquid extractor in a manner well known to those schooled in the art, and the polar and aromatic components of the distillate which are undesirable in a finished base oil (including the polar and aromatic compounds), are concentrated in the extract phase, leaving a relatively purified oil in the raffinate phase. Following vacuum distillation pursuant to the methods of this invention, relatively low solvent dosages in the area of 25% to 100% solvent to oil generally give satisfactory results, with the precise level dependent on the character of the oil, and the finished base oil quality and yield desired. Unless distilled according to the teachings of this invention, approximately twice the solvent dosage is required for comparable results.

Following extraction, the extraction solvent is separately stripped from the raffinate and extract phases and recovered for reuse. The stripped raffinate, typically 90% of the original lube distillate stream, is a finished base oil of high quality. The stripped extract, typically 10% of the original lube distillate stream, is suitable as a fuel or for fuel blending, and may optionally be blended with the light low boiling components of the oil, which have similar utility.

The invention can be more completely understood with reference to the accompanying drawing FIG. 1, which provides a schematic flow sheet of a preferred embodiment of the invention. In that the individual underlying process units in FIG. 1 are well known to those schooled in the art, they are presented in block schematic form, without enumeration of the pumps, valves, reactors, heat exchangers and other equipment which one of ordinary skill in the art will recognize are necessary for each process unit to function.

DETAILED DESCRIPTION OF THE INVENTION

Figure 1:
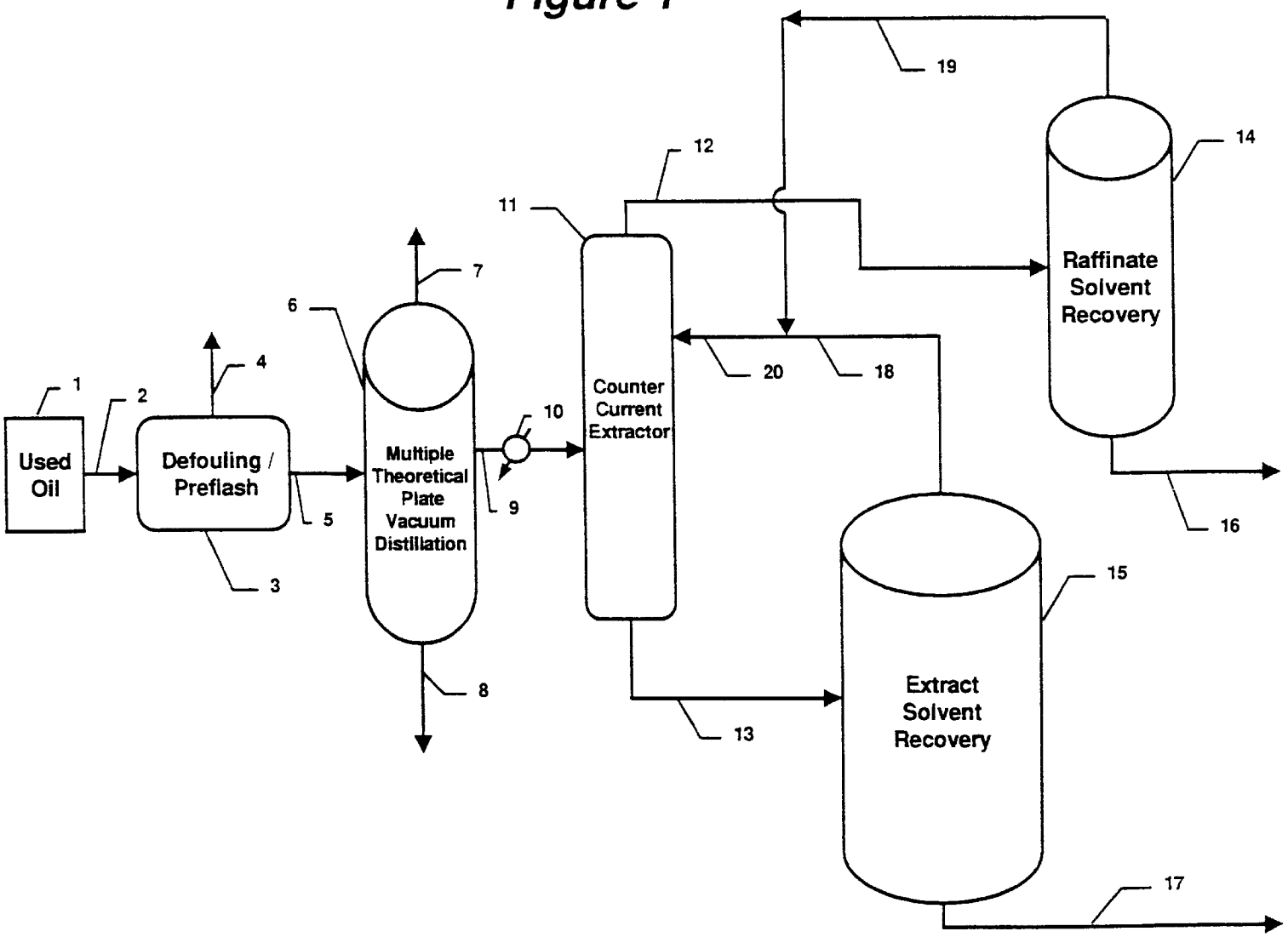
FIG. 1 is a schematic flow sheet of a preferred embodiment of the invention.

The invention is further clarified in the following example described with reference to FIG. 1. Used oil first enters from storage 1 via line 2 into defouling and preflash process unit 3. Process unit 3 preferably at least partially stabilizes or separates certain additives such as zinc dialkyldithiophosphate (ZDP) and other components of the used oil which otherwise may contribute to fouling on heating and inhibit continuous operation of vacuum distillation column 6, as well as other pieces of process equipment. Various mechanisms are acceptable, including without limitation alternative chemical and thermal treatment means such as are set forth in U.S. Pat. Nos, 4,247,389 and 4,420,389, separation of ZDP and other metallic compounds in a wiped film evaporator, as for example described in U.S. Pat. Nos. 4,101,414 or 4,941,967; their separation in conjunction with other additives by solvent extraction, as for example described in U.S. Pat. Nos. 5,286,380 and 5,556,548 or their thermal decomposition, which optionally may be integrated with the next, vacuum distillation step, as described in U.S. Pat. No. 5,306,419. The aforementioned treatment means typically and desirably also remove a least a portion of the water and light fuel components from the used oil, which pass from treatment unit 3 via line 4. Following separation via conventional means such as gravity separation, said water may be processed for disposal and said fuel may be used for plant operations, sold, or blended with other fuel byproducts of the process for sale as a composite fuel product.

Alternatively, although less preferably because of the attendant fouling and thus the relatively short period between column turnarounds which results from processing most (used) crankcase and cutting oils in this manner, process unit 3 may comprise only a pre-flash unit for water and light ends, employed in conjunction with commercial anti-foulant chemicals such as Nalco/Exxon Energy Chemicals LP dispersant 94BU260 and phosphate ester filmer EC5425A. Such chemicals, consistent with vendor recommendations, would be injected in line 5 upstream of any furnace (not shown) associated with vacuum distillation column 6, and injected in the pump around reflux loops (not shown) normally associated with vacuum distillation column 6 at vendor recommended concentrations. (Smaller amounts of these chemicals may also be desirable to complement the defouling treatments described in the above paragraph.) The simplified approach described in this paragraph is most likely to be acceptable for certain hydraulic oils or other oils which are relatively free of, or have been freed of, any contaminants which may cause fouling.

Following pretreatment, the oil is sent via line 5 to vacuum distillation column 6. A furnace (not shown) may be incorporated in line 5 prior to vacuum distillation column 6 if required to elevate the temperature of the oil to normal vacuum distillation temperatures. Vacuum distillation column 6 separates via fractional distillation the lube fraction of the oil having an atmospheric equivalent boiling range from approximately 650° F. to approximately 1000° F. Contrary to the teachings of pioneer U.S. Pat. No. 4,021,333, which reads in part "it is usually preferred to conduct the distillation without a fractionation column or similar apparatus", and contrary to usual re-refining practice, it is essential to the process of this invention that this distillation be effected in a fractionation column or other apparatus with more than one theoretical plate. It will preferably have more than one and one half, or more than two, or more than three theoretical plates.

Optionally, and not shown, the column may fractionate the lube fraction into several distinct distillation range and viscosity grades, all but one of which is sent to intermediate storage at any given time, which are then processed on a blocked out basis in counter current extractor 11 and the balance of the apparatus. As an alternative to blocked out operations when separate viscosity grades of oil are desired, each viscosity grade may be sent to a separate dedicated counter current extractor. Where multiple viscosity grades of oil are fractionated, however, it is desirable that effective fractionation with multiple theoretical plates separate even the heaviest base oil fraction from the asphaltic residue.

A vacuum tower such as the vacuum distillation column 31 of our co-pending applications previously referenced is well suited to this application. This column is of static packed design, providing a significant number of theoretical plates and relatively sharp discrimination between low and high boiling fractions; and is not of the wiped or thin film evaporator design typically employed for used oils.

Although there are a wide range of acceptable conventional design configurations for vacuum column 6, particularly preferred at this time is a packed tower (the terms "packed column" and "packed tower" are used interchangeably herein) employing low pressure drop structured packing or a combination of random packing in the lower portion of the column and structured packing in the upper portion, and with all lube distillate extracted as a single side stream into line 9 so that it can be immediately routed to a single finishing train. To further reduce the risk of fouling in this column it is desirable to have generous pumped reflux (not shown) to spray incipient fouling downward into the residuum from the packed sections.

Vacuum distillation column 6 will ordinarily incidentally separate a heavy residue stream with an atmospheric equivalent boiling range primarily above 1000° F., which passes through line 8, and may also separate any remaining light byproduct with an atmospheric equivalent boiling range primarily below 650° F., which passes through line 7. The light byproduct may be sold as fuel, blended and sold with other byproducts of the process or other fuels as a composite fuel, or applied in any other economically attractive basis. The heavy byproduct may be sold or used as an asphalt extender, or as fuel or fuel blending component.

Following vacuum distillation column 6, the lube fraction or fractions are routed via line 9 through cooler 10 to liquid liquid extractor 11, wherein they are contacted with a liquid liquid extractant such as N-Methyl-2-Pyrrolidone (NMP), furfural, or phenol, or suitable extractant mixtures, such as NMP with up to 1% water, at a temperature below the temperature of complete miscibility of the extractant and the oil. NMP is the preferred extractant, and extraction temperatures in the area of 100F to 150F have been found therewith to give good results. NMP dosages in the area of 25% to 100% of the oil by volume are preferred, but lower or higher amounts may be used if desired, depending on the quality of the finished end product desired. Contrary to the teachings of U.S. Pat. No. 4,071,438, which teaches contacting in a single stage mixer settler, liquid liquid extraction apparatus with multiple theoretical stages such as a packed column, rotating disk contactor, or Podbielniak extractor (or two or more Podbielniak extractors in series) are strongly preferred. Alternatively, multiple sequential mixer settler stages may be employed. Further contrary to the teachings of U.S. Pat. No. 4,071,438, nitrobenzene is an unattractive extraction solvent in light of its toxicity.

The density difference between the extract and raffinate phases is typically low when low solvent dosages such as are effective in the present invention are employed. Accordingly, it may be desirable when employing a countercurrent extractor wherein the phases contact by gravity (as distinct from a Podbielniak extractor or similar multistage centrifugal extractors) to operate the extraction step with a higher dry (that is, without water) solvent dosage effective for rapid separation of the two liquid phases of the extraction tower, and reflux the extraction tower by the introduction of water or wet solvent near the point of withdrawal of the extract phase towards the bottom of the extractor.

Following extractor 11, the raffinate phase, typically comprising 90% of the oil and 10% of the solvent, passes through line 12 to raffinate solvent recovery unit 14, where it is stripped of the minor amounts of solvent and any water therein, and the solvent itself is stripped of any water therein (although optionally a small amount of water, such as 1%, may be retained in the solvent if desired, and such minor amounts are known, in the case of NMP, to improve its selectivity). Similarly, the extract phase, typically comprising 90% of the solvent and 10% of the oil, passes through line 13 to extract solvent recovery unit 15, where it is stripped of its solvent and excess water. The solvent from solvent recovery units 14 and 15, stripped of water to the desired level, is thereafter collected, and passes through lines 18, 19, and 20 for reuse in countercurrent extractor 11. Small volumes of makeup solvent may be added periodically to the system as needed to compensate for unavoidable minor solvent decomposition or loss.

Solvent recovery units 14 and 15 will preferably be one or two stage distillation units with steam, ammonia, or inert gas stripping in the final or only stage. A reasonable configuration is to employ one stage solvent recovery under vacuum with inert stripping for the raffinate phase, and two stage solvent recovery, the first under slight positive pressure and the second under vacuum with inert gas stripping, to remove the heavier solvent load from the extract phase. The solvent recovery units may optionally be of designs developed for NMP recovery in virgin lube oil solvent refining units, such as are set forth in U.S. Pat. Nos. 3,461,066,4,057,491, 4,294,689, 4,342,646, 4,390,418, and 4,419,227; the disclosures of which are herein incorporated by reference. However, in light of the generally smaller proportion of solvent required to achieve satisfactory results in the process of the current invention, elaborate multiple effect solvent recovery schemes are generally not required. Reasonable thermal efficiencies can normally be achieved with one or two recovery stages, particularly if heat integration is practiced with the balance of the processing system, for example by employing the heat released by the oil as it is cooled from vacuum distillation column 6 (which typically would operate at absolute temperatures above 600F) to the preferred extraction temperature to at least partially heat the raffinate and extract phases to a solvent recovery temperature.

Following stripping of the solvent, the raffinate becomes a finished base oil suitable for sale as such, or for post finishing fractionation into different viscosity grades, and/or for compounding with additives to make a finished lubricating oil. Optionally, additional processing steps may be employed such as hydrotreating or clay finishing, or the oil may be further treated between vacuum distillation column 6 and countercurrent extractor 11, but such additional treatments are generally not required in the process of the present invention.

Following stripping of the solvent, the extract is suitable for use as an industrial fuel or for blending with other byproducts of the process or other fuels to make a composite fuel. Alternatively, the extract may first be cooled and/or treated with an anti-solvent such as water and placed in a temporary holding tank to cause a secondary raffinate of intermediate quality to rise to the surface, which secondary raffinate, after water stripping if required, can be returned with the lube fraction feed to primary extractor 11 to improve the overall yield of the process. Alternatively, the secondary raffinate can be separately stripped of solvent and water to make a lube stock of intermediate quality.

The following examples illustrate the improvement achieved from the practice of this invention. Color is used as an index of base oil product quality, however, other indicia of product quality are expected to be similarly affected, such as viscosity index, polynuclear aromatic content, and thermal and color stability.

EXAMPLE 1

This example illustrates the process of the present invention. A sample of used oil was prepared essentially as provided in our previously referenced co-pending applications, Example 1, through vacuum distillation Stage 3, which is effected in a packed column. Specifically, substantially the following procedure was employed.

500 grams of 18-46-0 DAP fertilizer pellets were ground to a fine powder in a Krups type 203 household coffee mill. The powder was then mixed in a two liter Pyrex beaker with 1.6 liters of tap water and the mixture heated to 130° F. (54° C.) on a stirring hot plate and magnetically stirred at that temperature for 15 minutes. The stir bar was then removed and the mixture allowed to settle for 48 hours, during which it separated into a dark brown liquid and a light brown mud like residue. The dark brown liquid was retained for use as an aqueous reagent in the demetallization phase of the rerefining process.

2,750 ml. of used oil obtained from a wholesale supplier was introduced into a 4 liter pyrex reaction kettle and vigorously stirred with a propeller mixer introduced through the middle kettle aperture as the mantle was electrically heated. The oil contained approximately 3% water by distillation and 0.5% ash by ASTM D482, and was opaque. The temperature of the oil was continuously monitored through one of the three side kettle apertures. A second side aperture was connected to a condenser apparatus to condense and collect overhead vapors, which condensate was maintained separately from the oil. Once the temperature of the oil reached 190° F. (88° C.), 96 ml. of the reagent prepared in Step 0 above was added through the third side aperture, after which that aperture was sealed. Full electric heating was continued to 220° F. (104° C.), then suspended for 15 minutes to slow the temperature ramp and allow formation of larger particulate, and then resumed until the temperature reading was 280° F. (138° C). The oil temperature continued to rise to about 300° F. (149° C.) due to the warmth of the mantle and then stabilized. The oil was maintained at about 300° F. (149° C.) under vigorous agitation for another 15 minutes, after which the apparatus was disassembled and the oil was decanted into a four liter Erlenmeyer flask. The separated condensate was examined and found to be comprised primarily of amber water with a thin layer of hydrocarbons floating thereon.

A three inch magnetic stir bar was then inserted into the four liter Erlenmeyer flask containing the decanted oil, a moderate rate of stirring was initiated, and the flask was heated to 630° F. (332° C.) on a twelve inch stirring hot plate, under a continuous gradual nitrogen purge administered to the side fitting of a ground glass connecting tube with side gas fitting (Corning 9420-24) placed in the neck of the flask. Overhead vapors were condensed and collected separately from the oil. The oil temperature was continuously monitored via an infrared thermometer and maintained in a range from about 610° F. (321° C.) to 650° F. (343° C.) for one hour. The flask was then removed from the hot plate without cooling and placed immediately into a custom fitted cloth insulating jacket, while continuing the nitrogen purge.

The flask was placed immediately into a 2 ft. by 2 ft. by 3 ft. vertical acrylic glove box with a slotted door permitting continuation of the nitrogen purge. Pre-positioned in the glove box was a 10½ inch 304 stainless steel Buchner funnel resting on a 4 liter Pyrex filter flask and under vacuum. The Buchner funnel had been prepared with 97 grams of Celatom FP-4 diatomaceous earth filter aid resting on a 24 cm. disk of Whatman #1 filter paper. The glove box was loosely sealed and a vigorous nitrogen flush of the glove box was initiated through four nitrogen feed lines until the measured oxygen 25 percentage in the box, as measured on a GC Industries GC 501 Oxygen monitor, declined to 0.00% $O_2$. At this point the nitrogen flush to the box was reduced to a level just sufficient to maintain positive pressure and, using the box gloves, the ground glass connecting tube which had fed the nitrogen purge to the flask was removed and the contents of the flask were poured into the Buchner funnel. Filtration was substantially complete in less than one minute.

Overall, this preprocessing was undertaken both to substantially demetallize the used oil and to make it susceptible to vacuum distillation in a conventional packed column with a greatly diminished risk of fouling relative to untreated used oil. It is illustrative of one of several types of optional preprocessing that may be employed with the methods of this invention. After filtration, the oil contained between 0.005% and 0.008% ash (as measured on different iterations of this experiment), but it remained dark in color. It was suitable only as a fuel, and not for reuse as base oil without additional processing.

The filtrate was then combined with the condensed overheads collected separately while the oil had been heated in the Erlenmeyer flask and placed in a five liter vacuum distillation flask and distilled under approximately 2 mm Hg crossbar vacuum through a 19 inch long two inch diameter distillation column packed with 6 mm porcelain Berl Saddles and insulated with several layers of heavy duty aluminum foil. Heating was via upper and lower electric mantles applied to the distillation flasks and controlled via a variable transformer to maintain pot pressure below 15 mm Hg and thus preclude the possibility of column flooding. The oil distilling in the fuel distillation range up to 650° F. (343° C.) atmospheric equivalent (or up to 320° F. (160° C.) at 2 mm Hg), was collected and set aside, and a new collection flask mounted, taking care to maintain vacuum throughout to prevent oxygen damage to the oil. Distillation was continued until the flask temperature had reached 680° F. (360° C.), at which point the crossbar temperature had reached 850° F. (454° C.) atmospheric equivalent (480° F. (249° C.) at 2 mm). A somewhat higher atmospheric equivalent maximum distillation temperature can be anticipated from a production scale vacuum tower. The distillation receiver containing the base lube distillate was then removed.

Four sequential extraction stages were then employed on a portion of the base lube distillate. In Stage 1,300 ml of the vacuum distillate was continuously mixed in a beaker on a stirring hot plate with 75 ml (25%) NMP as the mixture was heated to approximately 130F. The mixture was then poured into a separatory funnel, and allowed to cool to approximately 120F, which temperature was maintained as required with an electric forced air heat gun as separate extract and raffinate phases formed. The extract phase was drawn off the bottom of the funnel and set aside for later solvent recovery and extract separation, and the upper raffinate phase was retained for Stage 2. In Stage 2 the process was repeated with an additional 75 ml of NMP, employing the Stage 1 raffinate in place of the original distillate. After a total of four such stages, the final raffinate was transferred to a 2 liter round bottom flask, heated with upper lower electric mantles, maintained at 20" Hg vacuum, and stripped with a continuous nitrogen purge through a 25 mm diameter column packed with 19 cm of 6 mm ceramic berl saddles. Once the crossbar temperature reached 160C, heating was stopped, and the oil, now stripped of residual NMP, was cooled and the vacuum and nitrogen purge stopped. (A similar apparatus and process can be employed for separation of solvent from the extract phase.) As a final purification step unnecessary in a production configuration, the sample was filtered through two disks of Whatman #2 and one of Whatman #5 filter paper to remove silicon joint grease, dust and any other extraneous contaminants. The sample was then submitted to an independent laboratory for testing, with the following results:

| | |
|---|---|
| Viscosity @ 40° C. (ASTM D445) | 31.02 cst |
| Color (ASTM D1500) | <1.5 |

EXAMPLE 2

This example illustrates the relatively poor quality of oil, as reflected in ASTM D1500 Color, achieved employing the prior art method of U.S. Pat. No. 4,021,333 at a similar solvent dosage to Example 1, above. 1500 ml of used oil similar to that employed in Example 1 was placed directly in a five liter vacuum distillation flask and distilled under approximately 2 mm Hg crossbar vacuum through a 19 inch long approximately two inch diameter column insulated with several layers of heavy duty aluminum foil but without packing. Distillation was continued to approximately the distillation temperatures employed in Example 1, above. 300 ml of distillate was then finished employing the same four stage sequential extraction procedure followed by stripping set forth in Example 1, above. As in Example 1, 75 ml (25%) of NMP was employed at each stage. The final, stripped, filtered, product was then submitted to an independent laboratory for testing, with the following results:

| | |
|---|---|
| Viscosity @ 40° C. (ASTM D445) | 32.71 cst |
| Color (ASTM D1500) | <2.5 |

EXAMPLE 3

This example illustrates the increased solvent dosage required to achieve a comparable quality of oil, as reflected in ASTM D1500 Color, to the oil of Example 1, employing the prior art method of Example 2. 1000 ml of used oil similar to that employed in Examples 1 and 2 was placed directly in a five liter vacuum distillation flask and distilled under approximately 2 mm Hg crossbar vacuum through a 19 inch long approximately two inch diameter column insulated with several layers of heavy duty aluminum foil but without packing, as in Example 2. Distillation was continued to approximately the distillation temperatures employed in Examples 1 and 2, above. 300 ml of distillate was then finished employing the same four stage sequential extraction procedure followed by stripping employed in Examples 1 and 2, above. However, in the present instance, 150 ml (50%) of NMP was employed at each stage, twice the amount employed in Examples 1 and 2, above. The final, stripped, filtered, product was then submitted to an independent laboratory for testing, with the following results:

| | |
|---|---|
| Viscosity @ 40° C. (ASTM D445) | 32.69 cst |
| Color (ASTM D1500) | <1.5 |

The results in the current Example 3 are only comparable to and no better than the results achieved in Example 1, which employs the methods of the current invention, notwithstanding the doubling of solvent dosage in the present example, which does not.

The 50% reduction in solvent dosage achievable in accordance with the practice of the current invention is of great commercial significance. Operating and capital costs are both markedly reduced.

The major variable costs of operating a solvent extraction finishing unit are the cost of fuel for solvent recovery and the cost of solvent makeup for solvent losses. These in turn are at least directly proportional to the required solvent dosage at a given level of design complexity (number of solvent recovery stages, stripping column design, etc.). Indeed, given that a significant portion of initial thermal requirements in an efficient plant design can be met through heat integration with earlier process units, fuel consumption may decline more than 50% if the required solvent dosage is cut in half. Accordingly, a 50% reduction in required solvent dosage approximately halves the variable cost of operating a solvent extraction finishing unit.

A significant reduction in capital costs, on the order of 20%, can also be anticipated at a given level of design complexity as the result of halving the required solvent dosage. The size and capital cost of the countercurrent extractors and all solvent recovery systems, including pumps, heaters, and columns, are reduced at lowered solvent dosages.

When employing the methods of the current invention, rerefined base oil generally comparable in overall quality to hydrotreated base oil is readily achievable, at moderate solvent dosages less than or equal to 100% extractant to feed, when a multistage liquid liquid extractor is employed. For example, an ASTM D-1500 color of less than 1.0 is routinely achievable with a high degree of color stability on lighter base oil fractions of less than 200 SUS viscosity at 100° F. Moreover, rerefining according to the means of the current invention is particularly effective in reducing the polynuclear aromatic content of used oils, with levels (IP346 basis) of less than 0.5%, which are difficult to achieve via hydrotreating, easily achievable.

Just as importantly, and in contrast to prior art methods of liquid liquid extraction finishing applied to rerefining, engineering studies indicate that the present innovative process is substantially more economically attractive than hydrofinishing, with total direct operating cost for all equipment downstream of the distillation unit, (including maintenance and depreciation, but excluding labor, which should be comparable in either case) projected to be less than 50% of a typical rerefining hydrotreatment unit and a return on investment that is ten to fifteen percentage points higher over a wide range of base oil price assumptions.

Although the invention has been described in terms of the preferred and alternative embodiments disclosed herein, those skilled in the art will appreciate many variations, modifications and enhancements which fall within the spirit and scope of the invention as defined in the claims appended hereto. All such modifications and enhancements are intended to be included within the scope of the claims appended hereto.

What is claimed is:

1. A process for recovering base oil of lubricating viscosity from used oil, said process comprising the steps of:

distilling said used oil in a distillation apparatus comprising a packed column;

withdrawing at least a portion of at least one distillate fraction from said distillation apparatus for further finishing;

delivering at least a portion of said at least one withdrawn distillation fraction for further finishing;

extracting impurities from at least one said withdrawn distillate fraction with a liquid extractant;

removing at least a major portion of said extractant, and impurities dissolved therein, from said withdrawn distillate fraction;

wherein said distillation apparatus has more theoretical plates than distillate fractions being withdrawn from said distillation apparatus for further finishing.

2. A process as in claim 1, wherein said distillation apparatus comprises a vacuum column operating under reduced pressure.

3. A process as in claim 2, wherein said vacuum column comprises at least one of a random packing and a structured packing.

4. A process as in claim 1, further comprising a step of pretreating said used oil to remove entrained water and volatile low boiling components from said used oil.

5. A process as in claim 1, further comprising a step of pretreating said used oil to reduce said used oil's propensity to foul said distillation apparatus.

6. A process as in claim 5, wherein said step of pretreating said used oil to reduce fouling comprises a chemical treatment of the oil.

7. A process as in claim 5, wherein said step of pretreating said used oil to reduce fouling comprises thermal treatment of the oil at a temperature in excess of 400° F. for an average residence time of at least ten minutes.

8. A process as in claim 1, wherein the liquid extractant comprises a polar organic solvent.

9. A process as in claim 8, wherein the polar organic solvent is N-Methyl-2-Pyrrolidone.

10. A process as in claim 1, wherein said distillation apparatus has more than one and one half theoretical plates per distillate fraction being withdrawn from said distillation apparatus.

11. A process as in claim 1, wherein said distillation apparatus has more than two theoretical plates per distillate fraction being withdrawn from said distillation apparatus.

12. A process as in claim 1, wherein said distillation apparatus has more than three theoretical plates per distillate fraction being withdrawn from said distillation apparatus.

13. A process for recovering base oil of lubricating viscosity from used oil, said process comprising the steps of:

distilling said used oil in a distillation apparatus comprising a packed column;

withdrawing at least a portion of at least two distillate fractions from said distillation apparatus for further treatment;

extracting impurities from at least one of said withdrawn distillate fractions with a liquid extractant;

removing at least a major portion of said extractant, and impurities dissolved therein, from said at least one of said withdrawn distillate fractions;

wherein said distillation apparatus has more than one theoretical plate interposed between any two immediately adjacent distillate fractions withdrawn from said distillation apparatus.

14. A process as in claim 13, wherein said distillation apparatus comprises a vacuum column operating under reduced pressure.

15. A process as in claim 14, wherein said vacuum column comprises at least one of a random packing and a structured packing.

16. A process as in claim 13, further comprising a step of pretreating said used oil to remove entrained water and volatile low boiling components from said used oil.

17. A process as in claim 13, further comprising a step of pretreating said used oil to reduce said used oil's propensity to foul said distillation apparatus.

18. A process as in claim 13, wherein said step of pretreating said used oil to reduce fouling comprises a chemical treatment of the oil.

19. A process as in claim 17, wherein said step of pretreating said used oil to reduce fouling comprises thermal treatment of the oil at a temperature in excess of 400° F. for an average residence time of at least ten minutes.

20. A process as in claim 13, wherein the liquid extractant comprises a polar organic solvent.

21. A process as in claim 20, wherein the polar organic solvent is N-Methyl-2-Pyrrolidone.

22. A process as in claim 13, wherein said distillation apparatus has more than one and one half theoretical plates interposed between any two immediately adjacent distillate fractions being withdrawn from said distillation apparatus.

23. A process as in claim 13, wherein said distillation apparatus has more than two theoretical plates interposed between any two immediately adjacent distillate fractions being withdrawn from said distillation apparatus.

24. A process as in claim 13, wherein said distillation apparatus has more than three theoretical plates interposed between any two immediately adjacent distillation fractions being withdrawn from said distillation apparatus.

25. A process for recovering base oil of lubricating viscosity from used oil, said process comprising the steps of:

distilling said used oil in a distillation apparatus comprising a packed column;

withdrawing at least one distillate fraction and a bottoms fraction from said distillation apparatus;

extracting impurities from at least one said distillate fraction with a liquid extractant;

removing at least a major portion of said extractant, and impurities dissolved therein, from at least one of said withdrawn distillate fractions;

wherein said distillation apparatus has more than one theoretical plate for separating the bottoms fraction from the heaviest distillate fraction from which impurities are extracted using said liquid extractant.

26. A process as in claim 25, wherein said distillation apparatus comprises a vacuum column operating under reduced pressure.

27. A process as in claim 26, wherein said vacuum column comprises at least one of a random packing and a structured packing.

28. A process as in claim 25, further comprising a step of pretreating said used oil to remove entrained water and volatile low boiling components from said used oil.

29. A process as in claim 25, further comprising a step of pretreating said used oil to reduce said used oil's propensity to foul said distillation apparatus.

30. A process as in claim 29, wherein said step of pretreating said used oil to reduce fouling comprises a chemical treatment of the oil.

31. A process as in claim 29, wherein said step of pretreating said used oil to reduce fouling comprises thermal treatment of the oil at a temperature in excess of 400° F. for an average residence time of at least ten minutes.

32. A process as in claim 25, wherein the liquid extractant comprises a polar organic solvent.

33. A process as in claim 32, wherein the polar organic solvent is N-Methyl-2-Pyrrolidone.

34. A process as in claim 25, wherein said distillation apparatus has more than one and one half theoretical plates for separating the bottoms fraction from the heaviest distillate fraction withdrawn from said distillation apparatus.

35. A process as in claim 25, wherein said distillation apparatus has more than two theoretical plates for separating the bottoms fraction from the heaviest distillate fraction withdrawn from said distillation apparatus.

36. A process as in claim 25, wherein said distillation apparatus has more than three theoretical plates for separating the bottoms fraction from the heaviest distillate fraction withdrawn from said distillation apparatus.

37. A process for recovering base oil of lubricating viscosity from used oil, said process comprising the steps of:

distilling said used oil in a distillation apparatus comprising a packed column;

withdrawing at least two distillate fractions from said distillation apparatus;

extracting impurities from at least one said withdrawn distillate fractions with a liquid extractant;

removing at least a major portion of said extractant, and impurities dissolved therein, from at least one said withdrawn distillate fractions;

wherein said distillation apparatus has more than one theoretical plate for separating the lightest withdrawn distillate fraction from the immediately adjacent heavier distillate fraction from which impurities are extracted using said liquid extractant.

38. A process as in claim 37, wherein said distillation apparatus comprises a vacuum column operating under reduced pressure.

39. A process as in claim 38, wherein said vacuum column comprises at least one of a random packing and a structured packing.

40. A process as in claim 37, further comprising a step of pretreating said used oil to remove entrained water and volatile low boiling components from said used oil.

41. A process as in claim 37, further comprising a step of pretreating said used oil to reduce said used oil's propensity to foul said distillation apparatus.

42. A process as in claim 41, wherein said step of pretreating said used oil to reduce fouling comprises a chemical treatment of the oil.

43. A process as in claim 41, wherein said step of pretreating said used oil to reduce fouling comprises thermal treatment of the oil at a temperature in excess of 400° F. for an average residence time of at least ten minutes.

44. A process as in claim 37, wherein the liquid extractant comprises a polar organic solvent.

45. A process as in claim 44, wherein the polar organic solvent is N-Methyl-2-Pyrrolidone.

46. A process as in claim 37, wherein said distillation apparatus has more than one and one half theoretical plates for separating the lightest withdrawn distillate fraction from the immediately adjacent heavier distillate fraction from which impurities are extracted using said liquid extractant.

47. A process as in claim 37, wherein said distillation apparatus has more than two theoretical plates for separating the lightest withdrawn distillate fraction from the immediately adjacent heavier distillate fraction from which impurities are extracted using said liquid extractant.

48. A process as in claim 37, wherein said distillation apparatus has more than three theoretical plates for separating the lightest withdrawn distillate fraction from the immediately adjacent heavier distillate fraction from which impurities are extracted using said liquid extractant.

49. A process for recovering base oil of lubricating viscosity from used oil, said process comprising the steps of:

distilling said used oil in a distillation apparatus comprising a packed column;

withdrawing at least one distillate fraction and light by-product from said distillation apparatus;

extracting impurities from at least one said withdrawn distillate fractions with a liquid extractant;

removing at least a major portion of said extractant, and impurities dissolved therein, from at least one of said withdrawn distillate fractions;

wherein said distillation apparatus has more than one theoretical plate for separating said light by-product from the immediately adjacent heavier distillate fraction from which impurities are extracted using said liquid extractant.

50. A process as in claim 49, wherein said distillation apparatus comprises a vacuum column operating under reduced pressure.

51. A process as in claim 50, wherein said vacuum column comprises at least one of a random packing and a structured packing.

52. A process as in claim 49, further comprising a step of pretreating said used oil to remove entrained water and volatile low boiling components from said used oil.

53. A process as in claim 49, further comprising a step of pretreating said used oil to reduce said used oil's propensity to foul said distillation apparatus.

54. A process as in claim 33, wherein said step of pretreating said used oil to reduce fouling comprises a chemical treatment of the oil.

55. A process as in claim 53, wherein said step of pretreating said used oil to reduce fouling comprises thermal treatment of the oil at a temperature in excess of 400° F. for an average residence time of at least ten minutes.

56. A process as in claim 49, wherein the liquid extractant comprises a polar organic solvent.

57. A process as in claim 56, wherein the polar organic solvent is N-Methyl-2-Pyrrolidone.

58. A process as in claim 49, wherein said distillation apparatus has more than one and one half theoretical plates for separating said light by-product from the immediately adjacent heavier distillate fraction from which impurities are extracted using said liquid extractant.

59. A process as in claim 49, wherein said distillation apparatus has more than two theoretical plates for separating said light by-product from the immediately adjacent heavier distillate fraction from which impurities are extracted using said liquid extractant.

60. A process as in claim 49, wherein said distillation apparatus has more than three theoretical plates for separating said light by-product from the immediately adjacent heavier distillate fraction from which impurities are extracted using said liquid extractant.

* * * * *